US008128457B2

(12) United States Patent
Reinisch et al.

(10) Patent No.: US 8,128,457 B2
(45) Date of Patent: Mar. 6, 2012

(54) ATHLETIC BRA

(75) Inventors: Dana Reinisch, Portland, OR (US); Susan L. Sokolowski, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 731 days.

(21) Appl. No.: 12/234,052

(22) Filed: Sep. 19, 2008

(65) Prior Publication Data

US 2009/0098803 A1 Apr. 16, 2009

Related U.S. Application Data

(63) Continuation-in-part of application No. 11/111,775, filed on Apr. 22, 2005, now Pat. No. 7,435,155.

(51) Int. Cl.
*A41C 3/00* (2006.01)

(52) U.S. Cl. ..... 450/59; 450/76; 450/39

(58) Field of Classification Search ..... 450/2, 4, 450/39–41, 53–57, 30–33, 59, 62–64, 75, 450/76

See application file for complete search history.

(56) References Cited

U.S. PATENT DOCUMENTS

| | | | | |
|---|---|---|---|---|
| 5,643,043 | A | 7/1997 | Pflum | |
| 6,165,045 | A | 12/2000 | Miller et al. | |
| 6,186,861 | B1 | 2/2001 | Flaherty | |
| 6,540,585 | B1 * | 4/2003 | Lee | 450/38 |
| 7,089,597 | B2 | 8/2006 | Horii et al. | |
| 7,232,359 | B1 * | 6/2007 | Richardson | 450/86 |
| 7,435,155 | B2 * | 10/2008 | Reinisch et al. | 450/59 |
| 2002/0022433 | A1 | 2/2002 | Yeung et al. | |
| 2004/0133959 | A1 * | 7/2004 | Horii et al. | 2/69 |
| 2005/0255789 | A1 | 11/2005 | Gaudet et al. | |
| 2006/0183850 | A1 | 8/2006 | Liu et al. | |
| 2006/0252346 | A1 | 11/2006 | Reinisch et al. | |
| 2008/0096465 | A1 | 4/2008 | Liu | |

FOREIGN PATENT DOCUMENTS

| | | |
|---|---|---|
| EP | 1386548 | 4/2004 |
| FR | 2864429 | 1/2005 |

OTHER PUBLICATIONS

"Shock Absorber" Impact Level 3 Anti-Bounce Sports Bra, date unknown.

Information Disclosure Statement filed Sep. 27, 2005 in U.S. Appl. No. 11/111,775.

Office Action mailed Dec. 27, 2007 in U.S. Appl. No. 11/111,775.

Amendment filed Apr. 28, 2008 in U.S. Appl. No. 11/111,775.

Information disclosure statement filed Apr. 28, 2008 in U.S. Appl. No. 11/111,775.

International Search Report, mailed Jan. 9, 2008, from PCT Application No. PCT/US006/015005.

Notice of Allowance mailed Jun. 9, 2008 in U.S. Appl. No. 11/111,775.

International Search Report and Written Opinion mailed Mar. 9, 2010 in PCT Application No. PCT/US2009/057258.

International Preliminary Report on Patentability (including Written Opinion of the ISA) mailed Mar. 31, 2011 in International Application No. PCT/US2009/057258.

European Search Report dated Nov. 19, 2009 from European Patent Application No. 06824710.5.

* cited by examiner

*Primary Examiner* — Gloria Hale

(74) *Attorney, Agent, or Firm* — Plumsea Law Group, LLC

(57) ABSTRACT

A seamless athletic bra includes different regions with different levels of support. The bra is formed from layers of material adhered together. Altering the types of materials comprising the layers in a region changes the level of support in that region as compared with other regions of the bra. A first region having the lowest level of support is found in a back panel and in the molded cups. A second region having a medium level of support is found in the front portion of the strap. A third region having a high level of support is found in a framework that follows the contours of the molded cups and in a back portion of the strap.

25 Claims, 10 Drawing Sheets

ATHLETIC BRA

CROSS-REFERENCE TO RELATED APPLICATIONS

This application is a continuation-in-part of U.S. Pat. No. 7,435,155, currently U.S. application Ser. No. 11/111,775, entitled "Athletic Bra", filed on Apr. 22, 2005, and which was allowed on Jul. 25, 2008. The '775 application is incorporated herein by reference in its entirety.

BACKGROUND

The present invention relates generally to an athletic bra and more specifically to an athletic bra providing different levels of support in different regions of the bra and that includes a seamless front portion.

Women participating in athletic activities have long needed appropriate athletic bras to protect delicate breast tissue from damage and stretching due to inadequate support, excessive motion and bounce while at the same time providing comfort during all activities. There is also a need to compress and encapsulate the breasts to inhibit the bouncing motion inherent in running or jumping activities. Encapsulation provides support and breast separation. Compression of the breasts may also be preferred to prevent the breasts from impeding or interfering with certain movements, such as a golf swing.

Some typical athletic bras offer some amount of support to female athletes by providing as much compression as possible in the hopes that bringing the breasts as close to the body as possible will minimize bounce. These bras may accomplish maximum compression, but do not address encapsulation for comfort or aesthetics at all. Many of the Small, Medium or Large compression bras which generally have no adjustments are little more than tank tops made of elastic material sized to compress the breasts of the wearer. In general, typical athletic bras err on the side of comfort thereby sacrificing motion control and support. In addition, these tank-type bras leave a lot to be desired in aesthetics since they generally result in a single compressed mass across a woman's chest with no hint of supporting the breasts individually. A functional shortcoming of tank-type bras is that both breasts end up moving together which can mean more motion than necessary for some athletic activities. For many high intensity and/or high impact activities it is desired to provide motion control for each breast separately to avoid excessive bounce and unnecessary motion and transmission of motion between the breasts. Excessive bouncing can be painful and result in damaged and stretched breast tissue. Forcing both breasts to move together only compounds the problem by imparting motion to a larger mass.

One prior art bra called the "Shock Absorber" includes an inelastic band that is part of an H-shaped arch on the front extending from the outer side of one breast to the outer side of the other breast. The band appears to extend across the chest from one shoulder strap to the other above the breasts. The arch is not adjustable and is anchored at the sides of the rib band, at the straps and the tops of the cups. It is intended to provide some measure of motion control. However, the inelasticity of the band and lack of support, breast separation and adjustment do not address the fit and comfort criteria. Moreover, while the band may achieve a certain degree of motion control, there is no provision at all for individual encapsulation of the breasts.

Another shortcoming of some prior art bras concerns the materials used and the construction. Although cotton and cotton blends are comfortable materials when dry, they can become heavy and irritating when a wearer perspires during activities. In addition, the elasticity of these materials may be adversely affected by wetness. The prior art has addressed this material problem by using various polyester and other moisture control fabrics. The construction, however, has remained the same: either one uniform material throughout, or different materials and layers pieced together in a typical cut-and-sew construction. A single uniform material will not provide opportunities to customize areas of the bra for elasticity or inelasticity. In bras pieced from multiple pieces of fabric, the exposed sewn seams are often a source of chafing, skin irritation, itching, and other discomforts to the wearer.

Therefore, there exists a need in the art for seamless athletic bras that provide both encapsulation and compression support.

SUMMARY

A partially seamless athletic bra is provided to address the deficiencies of the art. The athletic bra is made of a laminate material, where different portions of the laminate provide different levels of support. The different levels of support are provided by different materials sandwiched in the laminate, although the outer layer and inner liner of the bra are generally the same over the entirety of the bra.

The laminate of the athletic bra generally includes three different regions: a first region providing relatively low support, a second regions providing increased support over the first region, and a third region providing increased support over the second region. The first region generally includes the cups and a back panel. The second region generally includes a front portion of the straps, and the third region generally includes a framework that follows a contour of the cups and a back portion of the straps. In some embodiments, the armholes, neckline, and rib band include flocked silicone.

In one aspect, the invention provides a bra comprising a first layer of material configured to contact a wearer's torso, a second layer of material adhered to the first layer of material, wherein a first portion of the first layer and a first portion of the second layer are molded to form a cup, a rib band associated with at least one of the first layer and the second layer, a framework, wherein the framework is formed from a second portion of the first layer, a second portion of the second layer, and a third layer of material that is disposed between and adhered to the first layer and the second layer, wherein the framework is configured to follow a contour of the cup, the framework providing a first level of support, the molded cup providing a second level of support, wherein the first level of support is greater than the second level of support, and wherein a front panel of the bra is seamless.

In another aspect, the invention provides a bra comprising a first region providing a first level of support, a second region providing a second level of support, and a third region providing a third level of support, wherein the first region comprises a molded cup, wherein the second region comprises a front portion of a strap, wherein the third region comprises a framework, and wherein an entirety of the bra is made from layers of material adhered together, and wherein a front panel of the bra is seamless.

In another aspect, the invention provides a bra comprising a body configured to contact a wearer's torso, an armhole formed in the body, a neckline formed in the body, and a rib band associated with the body, wherein at least one of the armhole, the neckline, and the rib band includes flocked silicone.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
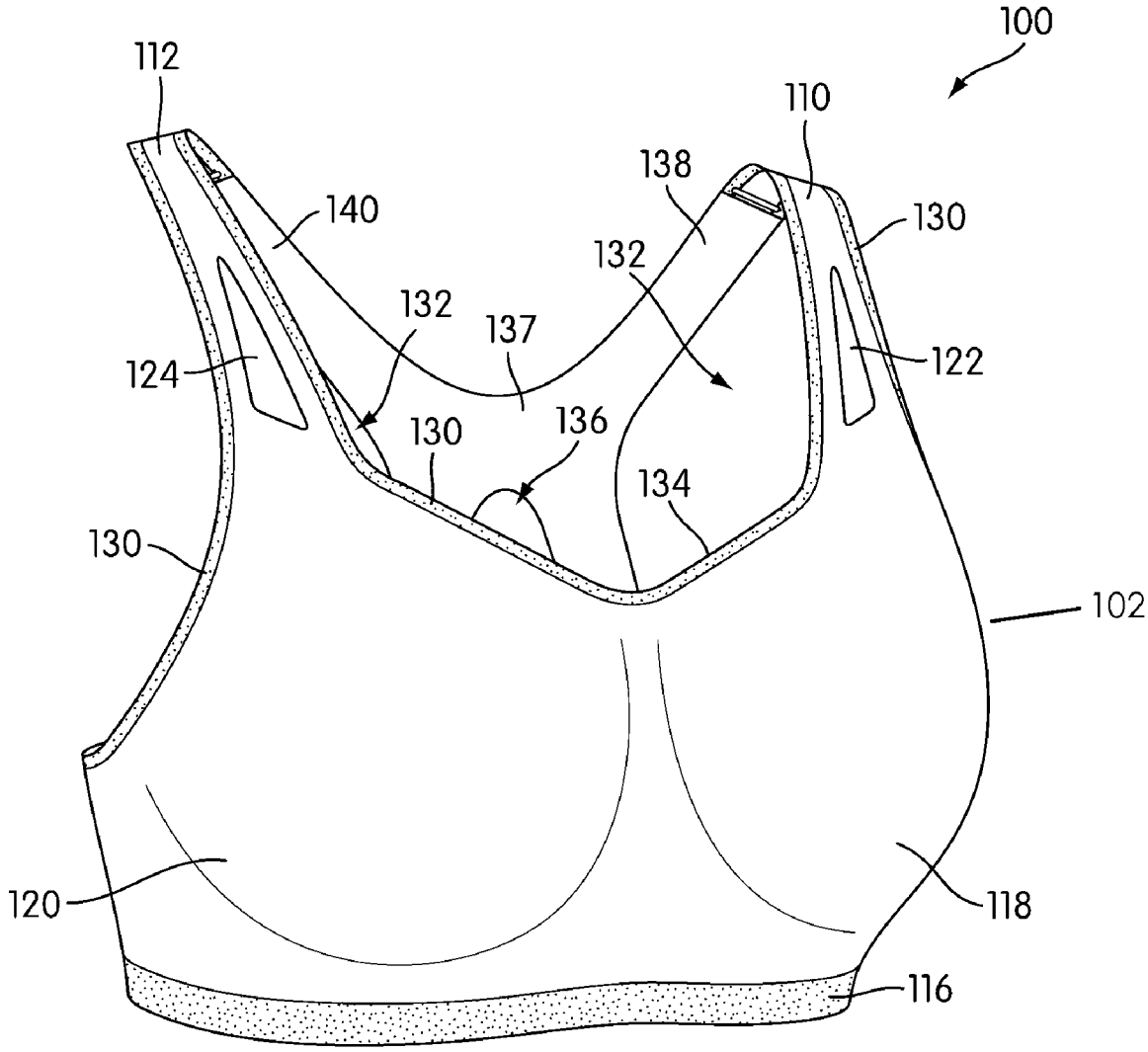
FIG. 1 is a schematic perspective view of an embodiment of a seamless athletic bra having different regions of support.
Figure 2:
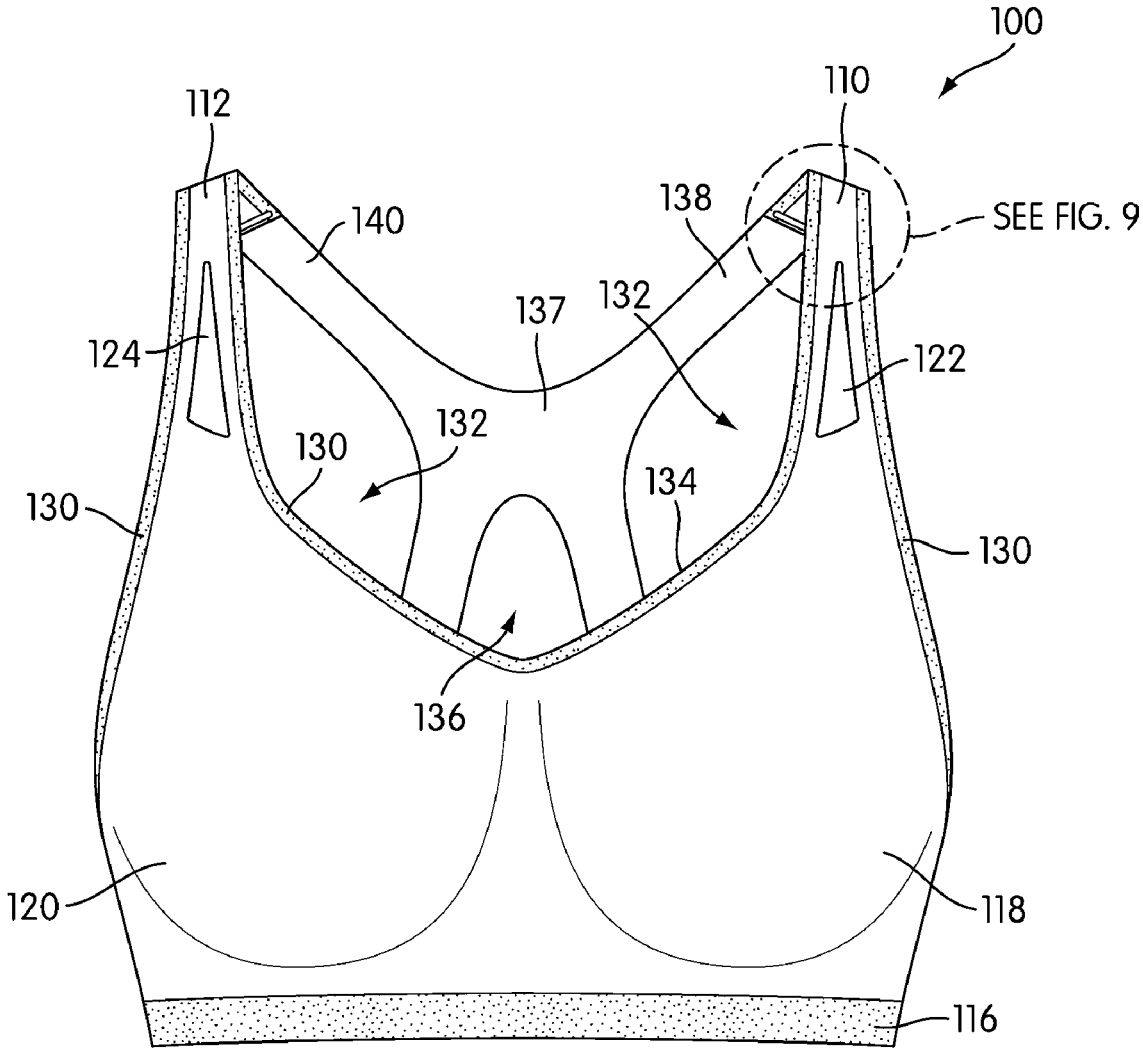
FIG. 2 is a schematic front view of an embodiment of a seamless athletic bra.

FIG. 1 is a perspective view of an embodiment of a molded seamless athletic bra 100. Generally, bra 100 includes a main body 102 and a rib band 116. Rib band 116 is generally configured to encircle a wearer's torso at the lower edge of bra 100 while main body 102 forms the remainder of bra 100. Rib band 116 may extend around the wearer's entire rib cage.

Figure 3:
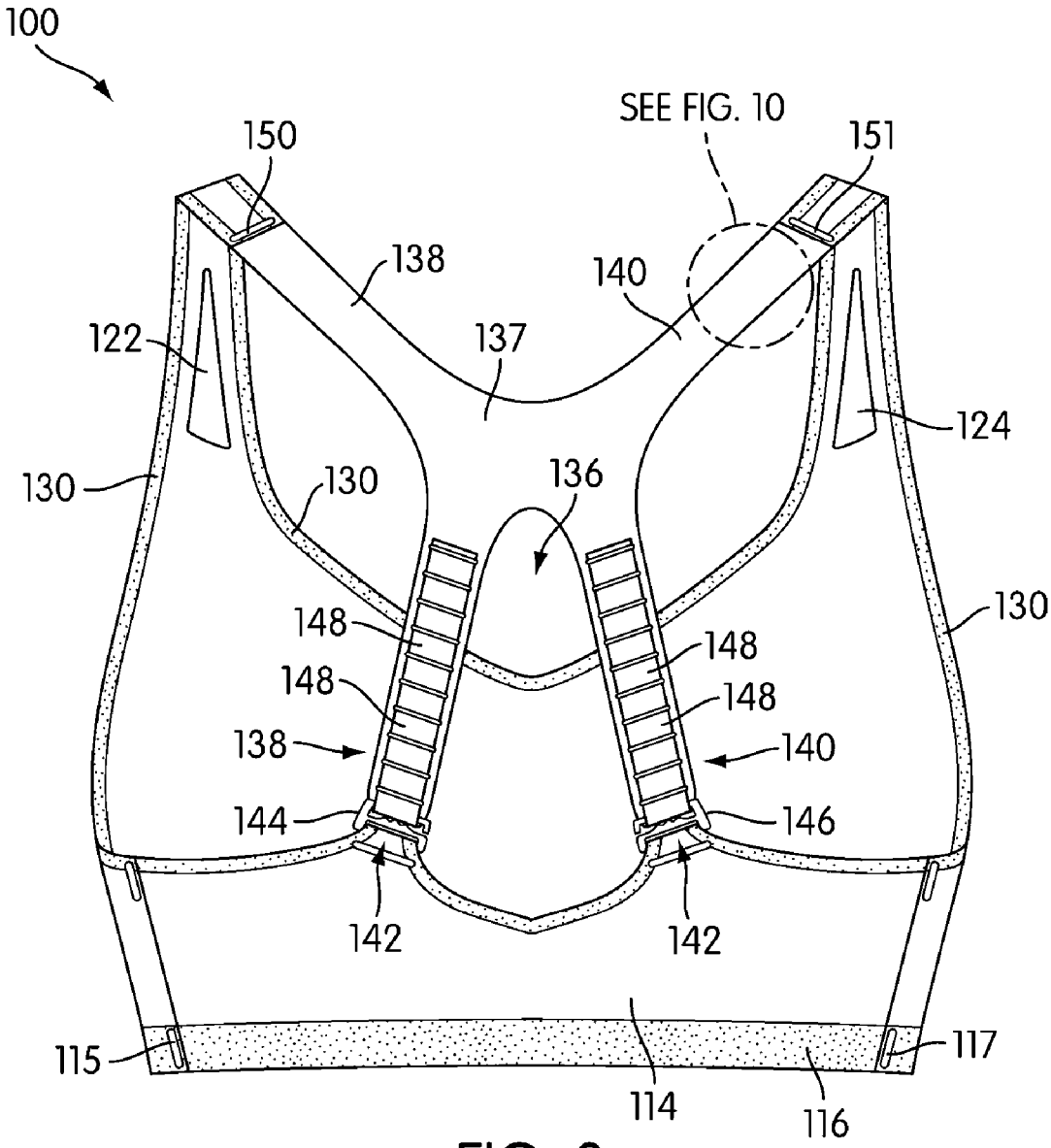
FIG. 3 is a schematic back view of an embodiment of a seamless athletic bra.
Figure 4:
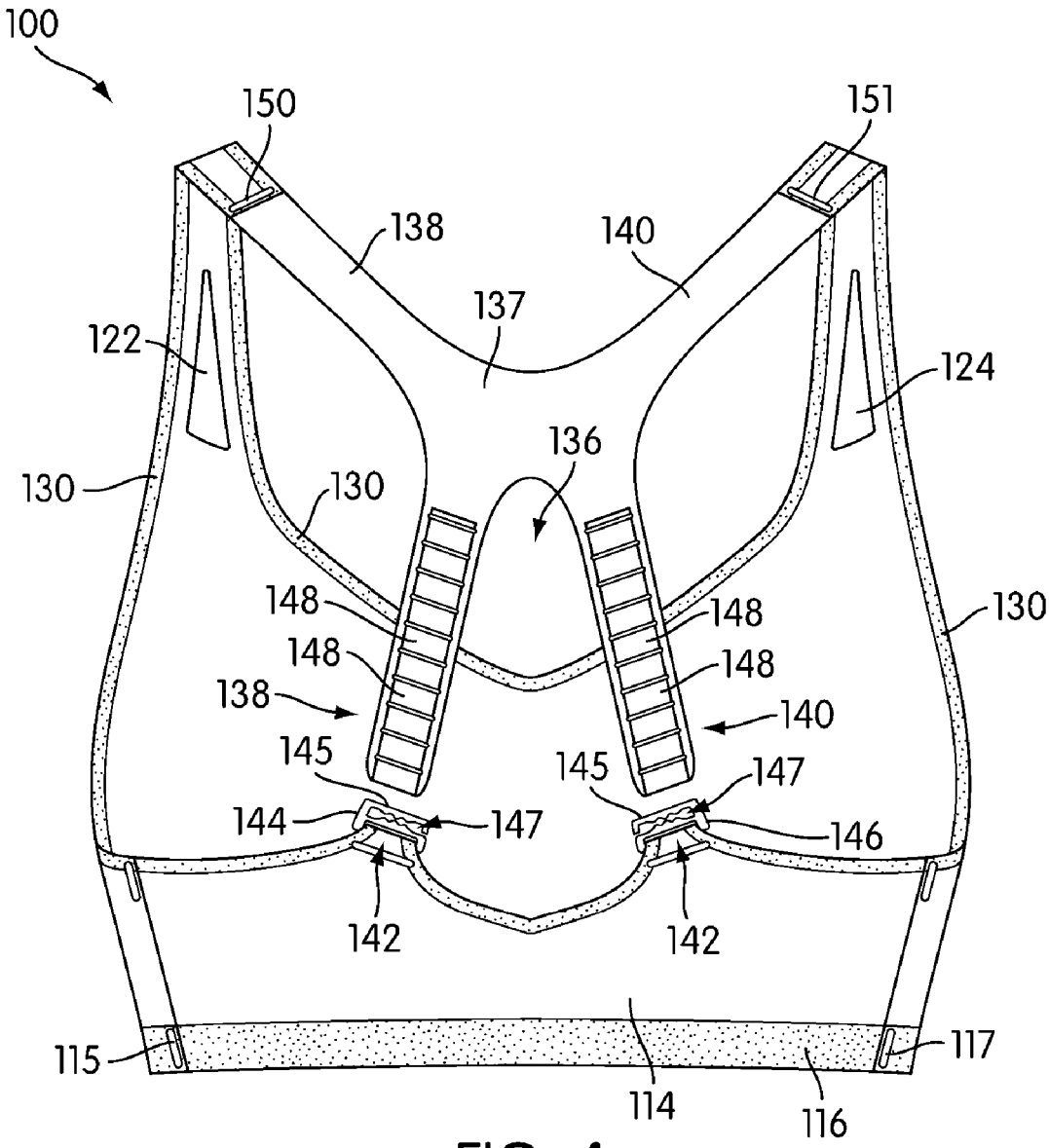
FIG. 4 is a schematic back view of an embodiment of a seamless athletic bra showing the straps in an open configuration.

Main body 102 generally includes a front portion configured to cover and support at least a portion of a front side of a wearer's torso and a back portion configured to cover and support at least a portion of a rear side of a wearer's torso. Front portion of bra 100 is shown in FIGS. 1-2, 5, and 6. The rear portion of bra 100 is shown in FIGS. 3, 4, and 7.

The front portion of bra 100 is seamless. For the purposes of this discussion, a seam is considered to be a visible interface, joining point, or transition point between the edges of two portions of material on an innermost or outermost surface of the bra. The portions may be overlapped and bonded together or stitched. In contrast, "seamless" is considered to include transition points between different portions of material that would not be visible to a user of the bra and that do not include significant edge overlapping or stitching. A unitary portion of an outermost layer or a unitary portion of an innermost layer is considered to be seamless.

For example, in the embodiments shown in the figures, different materials may be used to form different areas of bra 100. However, these materials are fused together with an adhesive, so no stitching is found on the bra. Main body 102 is formed of multiple layers of material adhered together to form a laminate. In some embodiments, such as those shown in the figures, the innermost and outermost layers of the material of main body 102 are continuous throughout main body 102 except for four regions of seams: first and second transition points 150 and 151 and third and fourth transition points 115 and 117, as shown in FIGS. 3, 4, and 7. In addition to physically supporting the wearer's breasts, the laminate is also durable in that that laminate has the ability to stretch or give slightly during use but recover to the original configuration. This characteristic of the laminate inhibits the loss of structural support provided by bra 100 over the life of bra 100, since the structural support is provided, at least in part, by the laminate itself.

In the embodiment shown in the figures, most alterations in the laminate may occur between these two layers so that a wearer encounters a smooth inner and outer surface of main body 102. In other words, the laminate may include portions of material sandwiched between the inner and outer layers. The edges of these portions of sandwiched material are not considered seams as these edges are not visible to the user and generally do not come into contact with the edges of the neighboring portions of material. The laminate construction of main body 102 is further discussed below.

The front portion of bra 100 includes two molded cups, a left cup 118 and a right cup 120. Cups 118 and 120 are each configured to receive and cover a breast of a wearer. Cups 118 and 120 are molded so that cups 118 and 120 retain their shape even when bra 100 is not being worn. Molded cups 118 and 120 are designed to encapsulate the wearer's breasts separately. Because no visible seams are provided between cups 118 and 120 and the surrounding portions of the front panel, the front panel including cups 118 and 120 is seamless. The outermost layer and in the innermost layer of the front panel are unitary portions of material.

Figure 5:
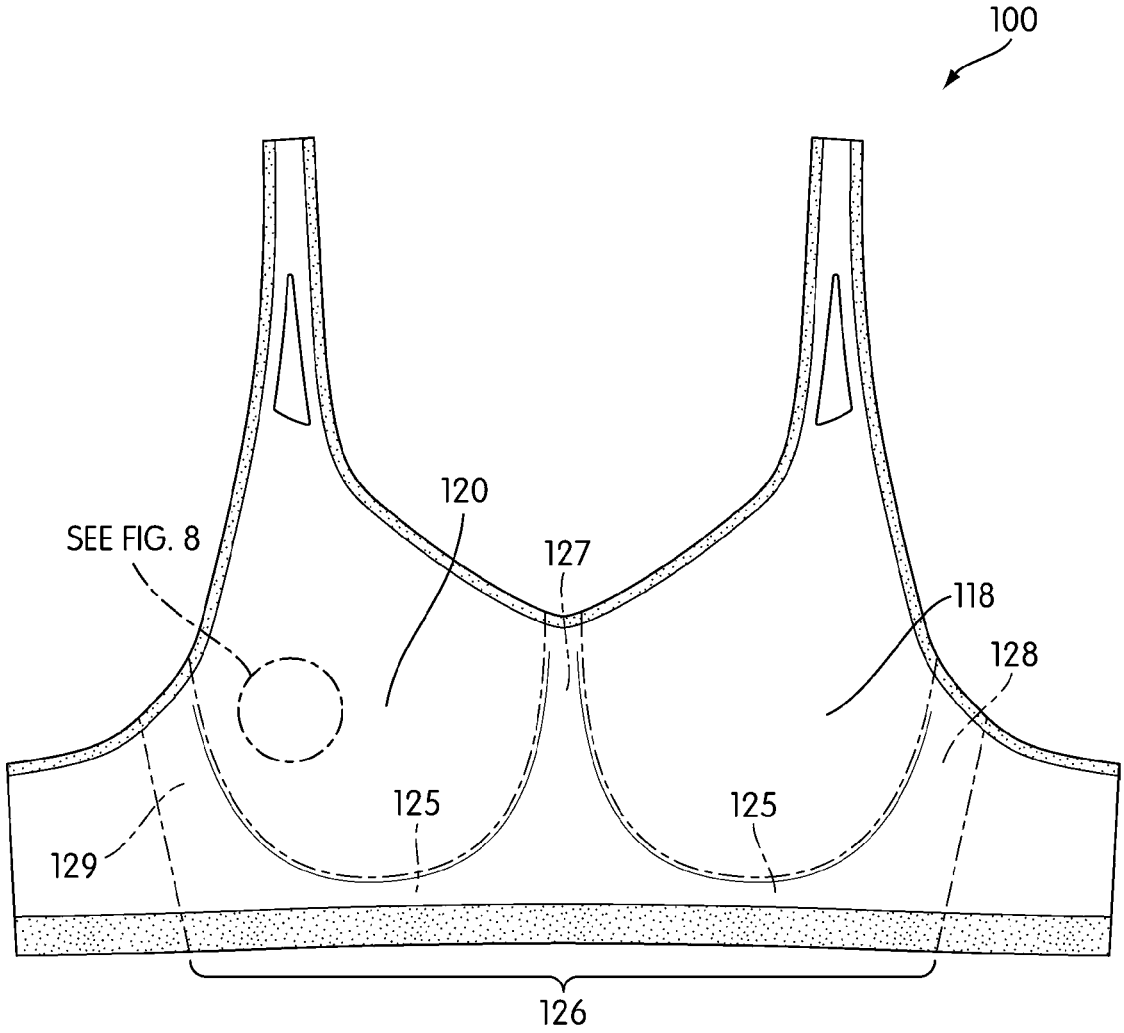
FIG. 5 is a schematic front view of an embodiment of a seamless athletic bra showing an internal framework configuration.

As shown in FIG. 5, front portion of bra 100 also includes an internal framework 126. Framework 126 is generally configured to follow the contours of cups 118 and 120. As shown in FIG. 5, framework 126 includes a base 125 that extends along and follows the contours of rib band 116 on a lower edge of base 125 and extends along and follows the contours of cups 118 and 120 on an upper edge of base 125. Framework 126 also includes three legs: a left leg 128 positioned on a lateral side of left cup 118, a right leg 129 positioned on a lateral side of right cup 120, and a center leg 127 positioned between left cup 118 and right cup 120. Framework 126 also does not generally extend across the tops of cups 118 and 120. In other words, framework 126 partially surrounds cups 118 and 120 in a W-shape.

Framework 126 is configured to simulate the underwire of a conventional bra, in that framework 126 defines and supports cups 118 and 120 to assist cups 118 and 120 to retain their shape. The additional support provided by framework 126 allows cups 118 and 120 to retain their shape even during medium or high impact wear. Framework 126 provides this support by providing additional stiffness to main body 102.

Molded cups 118 and 120, framework 126, and the laminate material of main body 102 are designed and work in tandem to provide both encapsulation and compression of the breasts. The independent functions of encapsulation and compression of the breasts are accomplished via both the materials used, the construction of bra 100, and the wearer's adjustment of the back straps.

Left and right front shoulder straps 110 and 112 are provided that extend from the front portion of bra 100 toward the back portion of bra 100. Front shoulder straps 110 and 112 are formed integrally with the front portion of bra 100 and extend upward from the front portion. Front shoulder straps 110 and 112 are configured to extend over the shoulders of the wearer and help to define armholes 132.

Additionally, front shoulder straps 110 and 112 may be provided with cutouts 124. Cutouts 124 are generally triangular-shaped holes extending through front shoulder straps 110 and 112, though cutouts 124 may have any shape. Cutouts 124 may be provided to enhance moisture management, by exposing a portion of the wearer's skin so that perspiration may more readily evaporate off of the skin as opposed to being absorbed by bra 100. Such absorption may make bra 100 heavy, unwieldy, or uncomfortable.

Cutouts 124 may also be provided to increase the flexibility of bra 100 in the shoulder region. Generally, removing material decreases stiffness and weight. Cutouts 124 may be positioned on front shoulder straps 110 and 112 so that straps 110 and 112 are more flexible at points that are flexed when the arms are moved across the body. This type of motion is seen in many sports, such as golf and racket sports. When making this motion while wearing bra 100, the wearer is not required to bend as much material as when no cutouts 124 are provided. This increases the flexibility of bra 100 and the comfort of wearing bra 100 for extended periods of time. Cutouts 124 also increase the comfort of wearing bra 100 by removing weight from bra 100.

In the embodiment shown in the figures, front shoulder straps 110 and 112 extend from the front, over the shoulders and transition to back shoulder straps 138 and 140 on the back portion of bra 100, as shown in FIGS. 3, 4, and 7. Front shoulder straps 110 and 112 transition to back shoulder straps 138 and 140 at first and second transition points 150 and 151. In some embodiments, first and second transition points 150 and 151 may be seams. In other embodiments, first and second transition points 150 and 151 may be seamless.

Back shoulder straps 138 and 140 extend downward to meet a back panel 114. In the embodiment shown in the figures, shoulder straps 110 and 112 join at point 137 prior to separating again to extend toward back panel 114. This defines a keyhole 136 in the back portion of bra 100 so that bra 100 includes racer back-style straps. This style of strap assists in maintaining the positioning of the straps on the wearer during times of intense activity. In other words, the straps are not likely to slip along or down the shoulders toward the elbow, even if the straps are loosely fitted. In other embodiments, no joining at point 137 may occur.

In some embodiments, back shoulder straps 138 and 140 include an adjustment system 142. In the embodiment shown in the figures, adjustment system 142 includes a series of adjustment ladders or slots 148 formed on each of back shoulder straps 138 and 140. Further, left and right adjustment hooks 144 and 146 are associated with a top edge of back panel 114. Adjustment hooks 144 and 146 may be horizontally oriented hooks configured with a top prong 145 and a gap 147 between top prong 145 and back panel 114, as are best shown in FIG. 4 which shows the straps in an undone or open position. Top prong 145 is configured to be received in adjustment slots 148, as shown in FIG. 3 which shows the straps in a done or closed position.

Multiple adjustment ladders or slots 148 are provided on each of the shoulder straps to provide several points of adjustment. This enables the wearer to customize the fit of the bra for comfort and a particular activity. The hook and slot type of adjustment of the shoulder straps provides a sure and fixed attachment point in contrast to the sliding buckle mechanisms found on shoulder straps of most bras. The sliding buckles frequently slip, causing the wearer to adjust the shoulder straps repeatedly.

In other embodiments, adjustment system 142 may include any type of adjustment mechanism known in the art. For example, some embodiments may utilize a traditional hook-and-eye adjustment system, where the hook may be fitted into any of a number of spaced-apart eyes.

Fixed length, non-adjustable shoulder straps may be employed as well. This is particularly true when the bra is made in a pull-over style. It may also be true if the bra is constructed for smaller bust sizes.

Even with adjustment system 142, bra 100 is generally configured to be used as a pull-over style. The wearer may put on bra 100 initially and adjust the straps to the desired length. The wearer may thereafter treat bra 100 as a pull-over-type bra so that she would not be required to adjust the straps again. The secure attachment of the straps to back panel 114 provided by vertical hooks 144 and 146 allow bra 100 to be worn in this fashion without having to readjust the straps periodically.

The remainder of the back portion of bra 100 generally includes back panel 114. Back panel 114 is configured to extend across the back of the wearer from a third transition point 115 to a fourth transition point 117. In some embodiments, third transition point 115 and fourth transition point 117 may include seams. In other embodiments, third transition point 115 and fourth transition point 117 may be seamless. Framework 126 is generally positioned on the other side of transition points 115 and 117 so that back panel 114 is generally associated with framework 126. Third transition point 115 and fourth transition point 117 are also locations where the front portion and back portion may be overlapped adhered together during the manufacturing process to provide the encircling capabilities of bra 100 around the wearer's torso.

As described above, the breasts are individually encapsulated by molded cups 118 and 120. Separation of the breasts is also ensured by way of center leg 127 of framework 126, which puts a physical barrier between the two breasts. It has been found that individual encapsulation provides independent motion control to each breast, thereby reducing the motion imparted to the breasts by prior art bras which treat the two breasts as a single mass.

Center leg 127 of framework 126 is particularly effective in preventing or reducing lateral movement of the breasts. For the purposes of this discussion, lateral movement is considered to be the side-to-side movement of the breasts, i.e., towards the arms or towards each other. This motion is differentiated from axial movement which is considered to be the up-and-down motion of the breasts, i.e., toward and away from the neck. By providing additional stiffness in the area between cups 118 and 120, center leg 127 achieves lateral lockout, or the inhibition of lateral movement of the breasts.

As discussed above, main body 102 is generally formed from layers of material. In order to provide a seamless configuration, main body 102 generally includes a single inner layer and a single outer layer. However, bra 100 is provided with different regions having different levels of support due to the laminate construction. These different regions are defined by additional layers of material sandwiched between and adhered to the single inner layer and the single outer layer.

Figure 6:
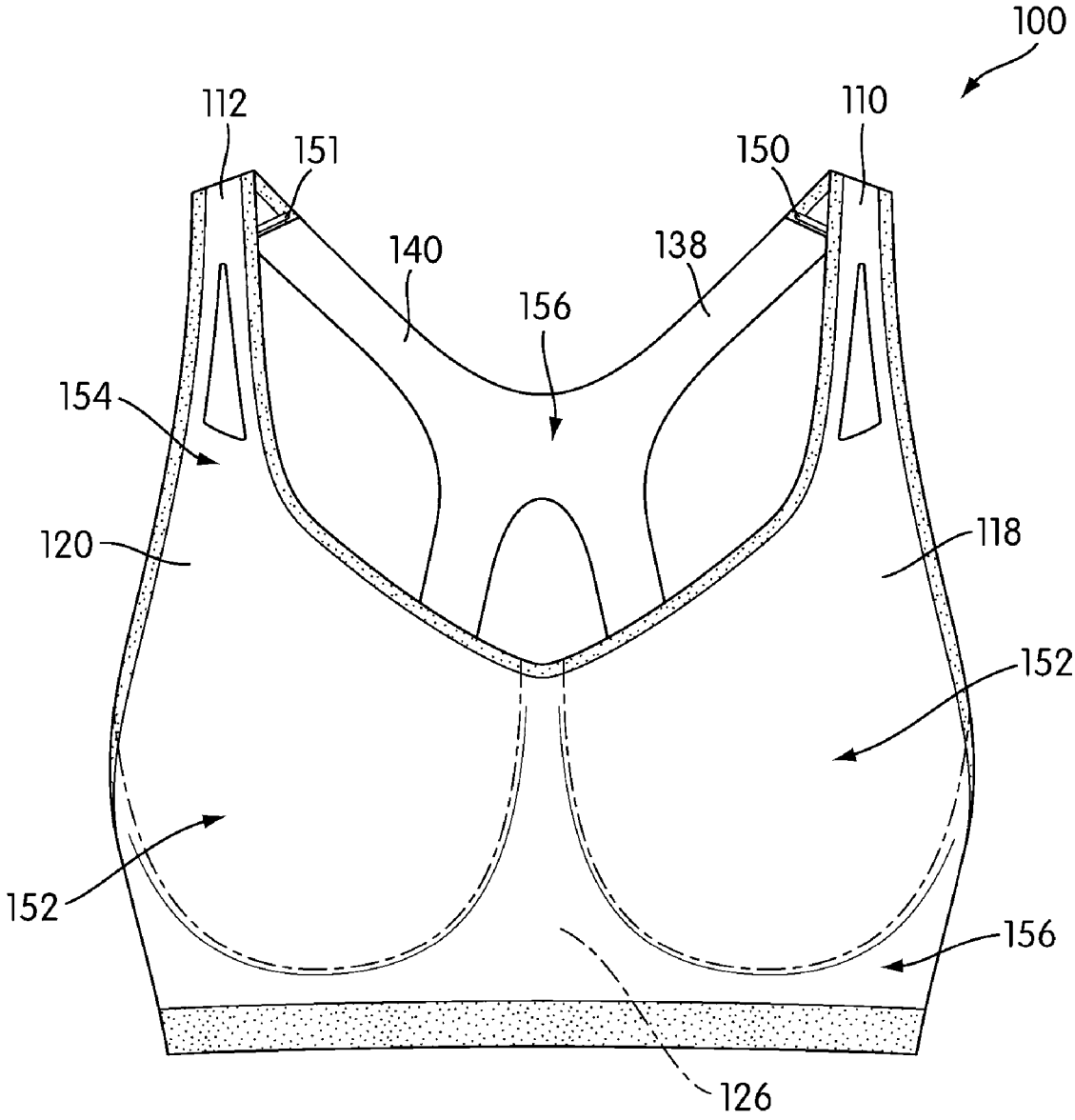
FIG. 6 is a schematic front view of an embodiment of a seamless athletic bra showing the different regions of varying support.
Figure 7:
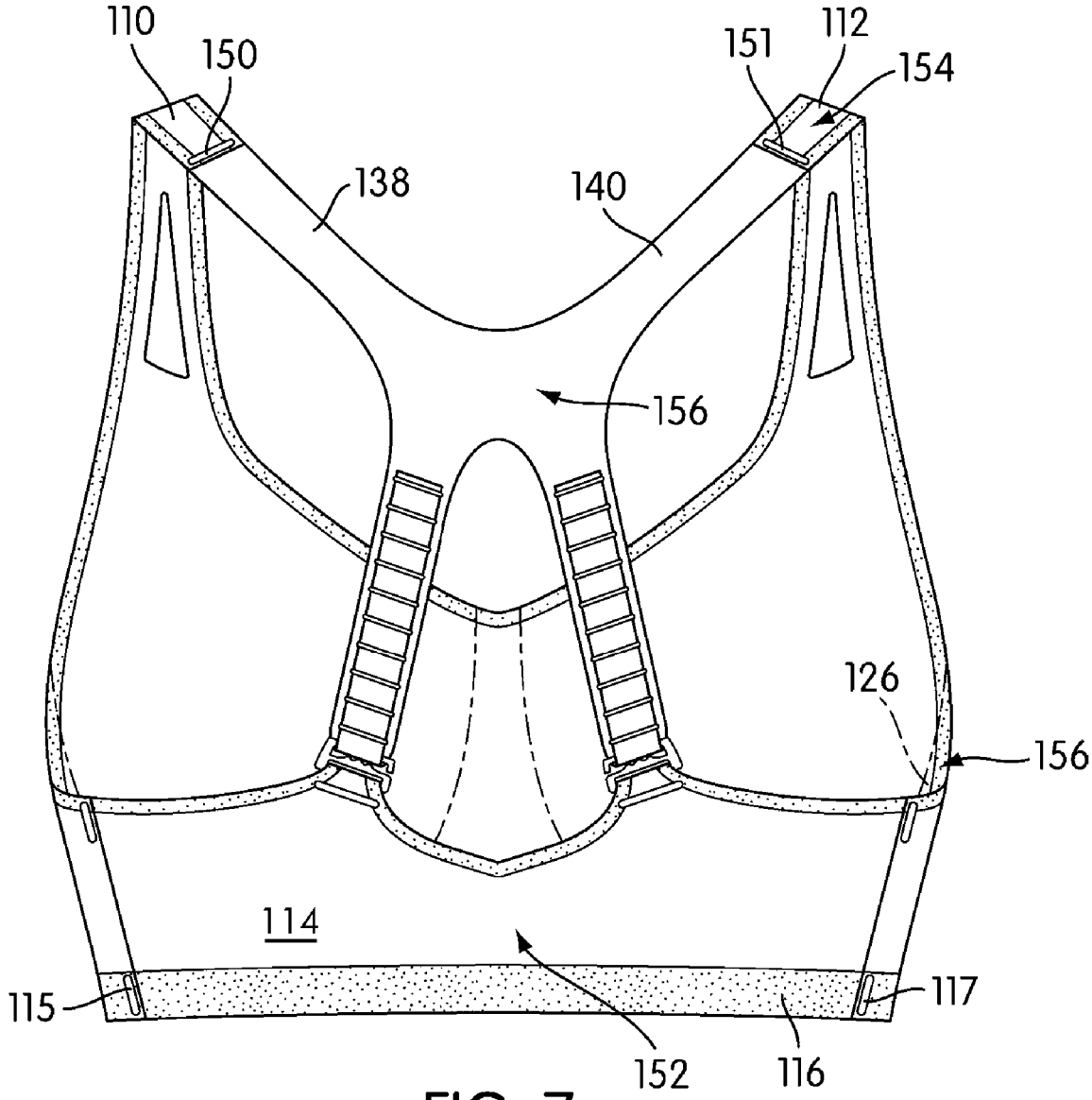
FIG. 7 is a schematic back view of an embodiment of a seamless athletic bra showing the different regions of varying support.

FIG. 6 shows one embodiment of the different regions or zones for the front portion of bra 100. A first support zone 152 includes molded cups 118 and 120. A second support zone 154 includes front straps 110 and 112, from the tops of molded cups 118 and 120 to transition points 150 and 151. A third support zone 156 includes framework 126. Generally, in this embodiment, first support zone 152 has a first, relatively low level of support provided by the laminate. Second support zone 154 has a second, medium level of support provided by the laminate. Third support zone 156 has a third, relatively high level of support provided by the laminate.

Similarly, FIG. 7 shows one embodiment of the different regions of zones of support for the back portion of bra 100. First support zone 152 includes back panel 114, which extends from a third transition point 115 to a fourth transition point 117. Third support zone 156 includes back straps 138 and 140, from transition points 150 and 151 to and including adjustment slots 148.

The different levels of support provided in the different regions of bra 100 may be attributed to the different layers of the laminate material used to form main body 102. Placing certain materials in the different regions generally alters the stiffness of the material in that region. Lower stiffness generally translates into a lower level of support. Additionally, the amount of stretch provided in a material contributes to its stiffness. Low and non-stretch materials generally have higher stiffness than stretch materials. "Non-stretch" refers to materials with no elastic components and therefore negligible stretch characteristics. That is, the material itself is non-stretch and any limited stretch exhibited is a result of mechanical movement in the weave of the fabric.

Figure 8:
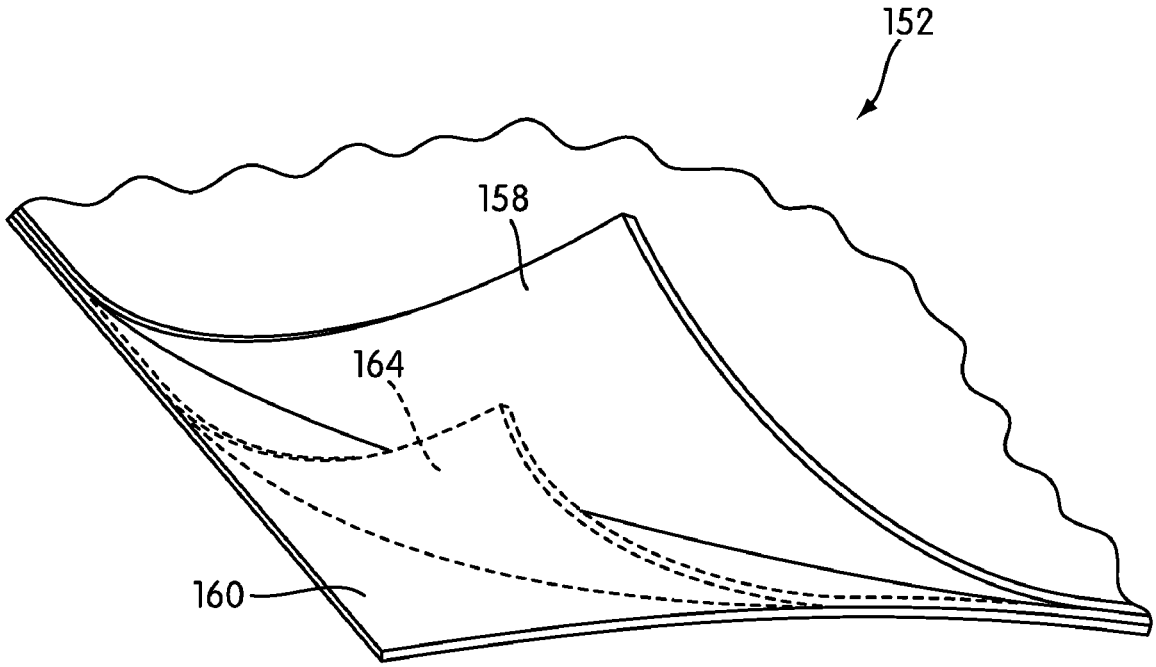
FIG. 8 is a schematic cross-sectional view of a first region showing the different layers of material.

For example, first support zone 152 includes molded cups 118 and 120. The different layers for molded cups 118 and 120 are shown in FIG. 8. First support zone 152 includes a layer of inner liner material 160 and a layer of the outer body material 158. Inner liner material 160 is generally positioned on bra 100 to be in direct contact with the wearer's skin, while outer body material 158 forms the exposed portion of bra 100. Inner liner material 160 may be any material capable of being bonded to another material. Inner liner material 160 may also be a material having low stretch properties so that molded cups 118 and 120 are able to better retain their shape during use and over time.

Due to the positioning of inner liner material 160 against the wearer's skin, the material in some embodiments may be selected for comfort, such as by providing wicking and anti-chafing properties. In one embodiment, the material for inner liner material 160 may be a synthetic blend, such as a polyester and spandex material blend. In one embodiment, the blend may be 97% polyester and 7% spandex. In some embodiments, the material of inner liner material 160 may be knitted or double knitted.

Similarly, outer body material 158 may be any material capable of being bonded to another material. Due to the positioning or outer body material 158, outer body material 158 may be selected for other considerations, including anti-chafing properties so as not to irritate the wearer's arms, durability, and ease of providing aesthetic embellishments, such as patterns, dyes, and/or affixed items. Outer body material 158 may include stretch, limited stretch, or non-stretch materials. In some embodiments, outer body material 158 may include stretch materials. However, when the layers of material are adhered, the material having the lowest amount of stretch generally controls the overall amount of stretch for the laminate. In some embodiments, outer body material 158 may include a synthetic blend, such as polyester and spandex blends. In one embodiment, outer body material 158 may include a blend of 66% polyester and 34% spandex.

Inner liner material 160 and outer body material 158 are adhered together, such as with a layer of adhesive film 164. Unlike conventional bras, the layers of molded cups 118 and 120 are adhered together over the entirety of molded cups 118 and 120 and not just along the periphery of the cups. This allows for no free play between materials 160 and 158, so that cups 118 and 120 may provide a greater level of support.

Figure 9:
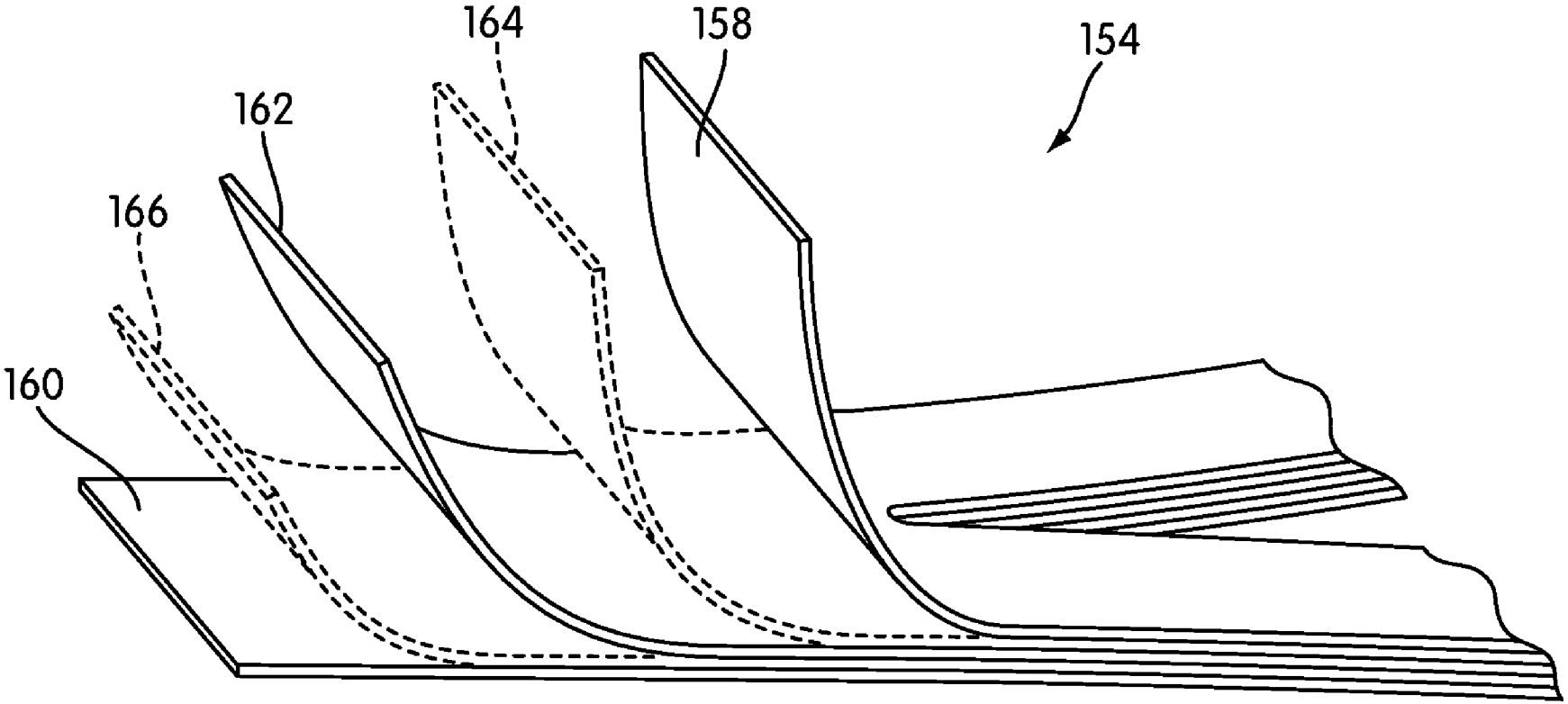
FIG. 9 is a schematic cross-sectional view of a second region of support showing the different layers of material.

FIG. 9 shows the layers of second support zone 154, which includes front straps 110 and 112. While first support zone 152 includes only two layers of material, second support zone 154 includes three layers: inner liner material 160, outer body material 158, and a medium support material 162. These layers are adhered together, such as with first and second layers of adhesive film 164 and 166. Medium support material 162 generally increases the stiffness of bra 100 in second support zone 154 as compared with first support zone. This is accomplished in part by virtue of adding another layer of material. Increased thickness generally yields increased stiffness. Additionally, in some embodiments, medium support material 162 may be a non-stretch material, where both inner liner material 160 and outer body material 158 include some stretch properties. The lack of stretch properties in medium support material 162 also increases the stiffness of the laminate in second support zone 154.

In some embodiments, medium support material 162 may be a synthetic material or blend of materials. In some embodiments, medium support material 162 is polyester or nylon. In some embodiments, medium support material 162 may be knitted and/or creped. Medium support material 162 may include wicking properties for comfort, and creping the material may enhance these and other properties, such as heat dissipation.

Figure 10:
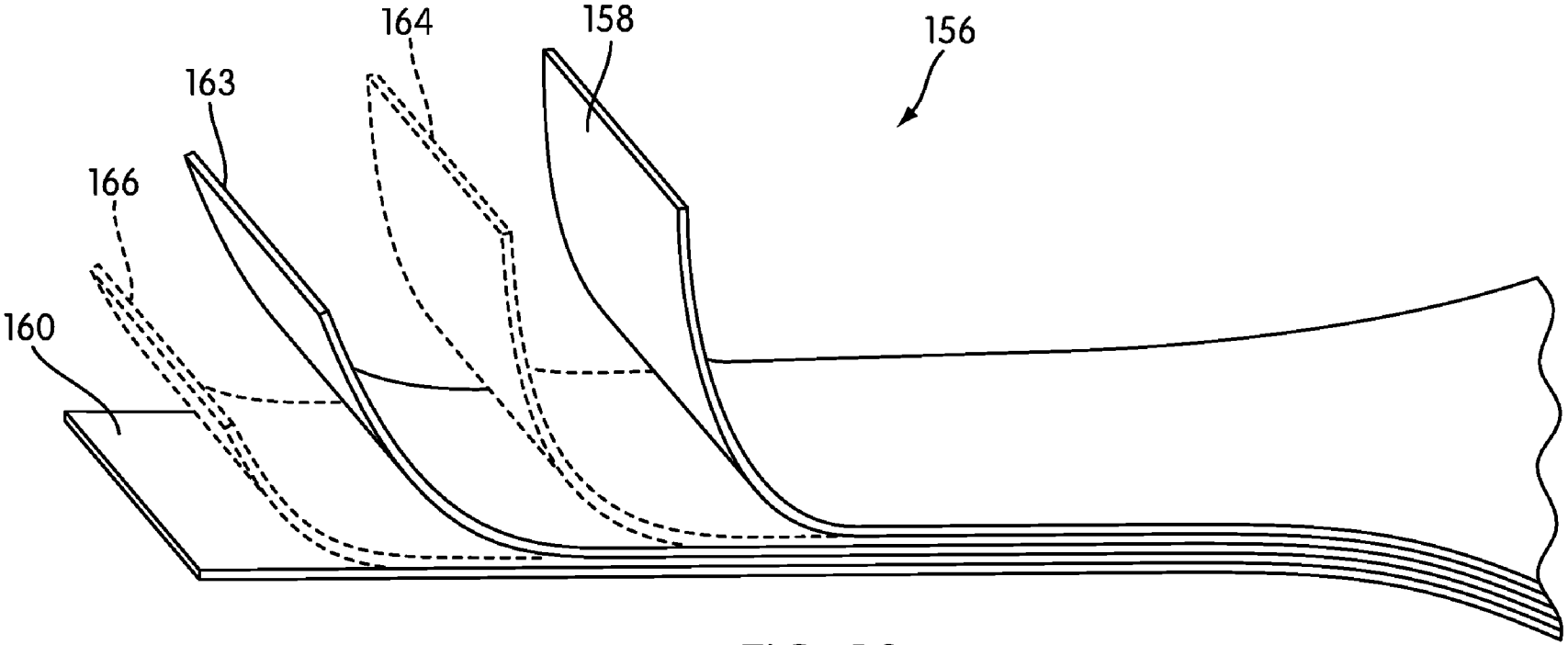
FIG. 10 is a schematic cross-sectional view of a third region of support showing the different layers of material.

FIG. 10 shows the layers of third support zone 156, which includes framework 126 and back straps 138 and 140. Similar to second support zone 154, third support zone 156 includes three layers: inner liner material 160, outer body material 158, and a high support material 163. These layers are adhered together, such as with first and second layers of adhesive film 164 and 166. High support material 163 generally increases the stiffness of bra 100 in third support zone 156 as compared with second support zone 154. This is accomplished because high support material 163 is more stiff than medium support material 162. High support material 163 may be a similar material as medium support material 162 only having a greater thickness. In other embodiments, high support material 163 is a different material than medium support material 162, where the fibers and/or construction of high support material 163 increases the stiffness of high support material 163 over that of medium support material 162. For example, high support material 163 may have a denser weave than that of medium support material 162. In some embodiments, high support material 163 may be a mesh or a knit mesh.

In some embodiments, high support material 163 may be non-stretch, such as a knitted polyester. However, non-stretch materials may be uncomfortable as high support material 163 may become unwieldy at greater thicknesses without providing some stretch characteristics. In some embodiments, high support material 163 may include some stretch materials. For example, in some embodiments, high support material 163 may be a synthetic blend, such as polyester and spandex. In one embodiment, high support material 163 may include 79% polyester and 21% spandex. Therefore, while back straps 138 and 140 may include the most stretch, the overall stiffness of the laminate in back straps 138 and 140 is sufficient to provide the highest level of support.

Notably, while molded cups 118 and 120 include the lowest level of support from the laminate characteristics of the material, molded cups 118 and 120 provide greater support than back panel 114 even though molded cups 118 and 120 and back panel 114 may be made from the same laminate.

This is because the molding of cups 118 and 120 define and encapsulate the wearer's breasts. Additionally, the stretch of the laminate in the cups 118 and 120 is reduced during the molding process, as processing with heat and straining the material alters the structure of the material. This makes cups 118 and 120 slightly more stiff than back panel 114, even though the same layers of material may be used for both sections of bra 100. Therefore, molded cups 118 and 120 represent a fourth region of support when both laminate characteristics and other structural characteristics of bra 100 are considered.

Main body 102 may be manufactured in any manner known in the art for making laminated articles. For example, in one embodiment, to manufacture main body 102, portions of inner liner material 160 and outer body material 158 in the shape of main body 102 are provided, such as by cutting the pieces from larger bolts of material. Inner liner material 160 may then be placed within a mold sized and shaped like the finished bra with molded cups 118 and 120. Second adhesive film 166 may then be positioned on top of inner liner material 160.

Pieces of medium support material 162 sized and shaped to define second support zone 154 are provided, such as by cutting the pieces from larger bolts of material. These pieces of medium support material 162 are then positioned on inner liner material 160 so that second support zone 154 is established. For example, in the embodiment shown in the figures, the pieces of medium support material 162 would be positioned on the front shoulder straps.

Pieces of high support material 162 sized and shaped to define third support zone 156 are provided, such as by cutting the pieces from larger bolts of material. These pieces of high support material 163 are then positioned on inner liner material 160 so that third support zone 156 is established. For example, in the embodiment shown in the figures, the pieces of high support material 162 would be positioned around the cup area to form framework 126 and on back shoulder straps 138 and 140.

First adhesive film 164 is then positioned on the pieces of medium support material 162 and high support material 163. Finally, outer body material 158 is positioned on top of the entire assembly. The mold is closed and heat and pressure are applied. The heat may be sufficient to melt first adhesive film 164 and second adhesive film 166. This process fuses the layers together into a single laminate and also provides molded cups 118 and 120 with their shape. First adhesive film 164 and second adhesive film 166 may impregnate the layers of material so that first adhesive film 164 and second adhesive film 166 essentially disappear into the fabric of main body 102.

In some embodiments, additional portions of bra 100 may be applied or associated with main body 102 prior to molding main body 102 to form the laminate and establish the shape of bra 100. Rib band 116 may be associated with a lower edge of main body 102. Additionally, edging 130 may be provided for additional comfort and durability around armholes 132 and along neckline 134. In some embodiments, rib band 116 may be a portion of elastic material that is folded over a lower edge of main body 102 and adhered in position during the bonding process. Similarly, edging 130 may be a similar portion of elastic material that is folded over the edges of main body 102 proximate armholes 130 and neckline 134.

The elastic material for rib band 116 and/or edging 130 may be any type of material capable of being bonded to other layers of material. In some embodiments, the elastic material for rib band 116 and edging 130 may be the same material. In other embodiments, the elastic material for rib band 116 and edging 130 may be different materials. In some embodiments, the material for rib band 116 may be a plush material for additional comfort. In some embodiments, the material for edging 130 may be a foldover elastic, such as a nylon and spandex blend. In one embodiment, the material for edging 130 is a 69% nylon 31% spandex blend.

In other embodiments, the rib band 116 and edging 130 may be applied to main body 102 after main body 102 has been removed from the mold. In one such embodiment, a layer of silicone is applied to the surface of main body to establish the boundaries of rib band 116 and edging 130. The layer of silicone may be applied on inner liner material 160, outer body material 158, or both. The layer of silicone may be applied using any method known in the art, such as by screen printing. The layer of silicone is then heated so that the silicone impregnates the fabric of main body 102 for a secure adhesion. The layer of silicone may then have a surface texture applied, such as by flocking.

The layer of silicone imparts elastic properties to main body 102 so that, for example, main body 102 may grip the wearer more closely where the layer of silicone is applied. The wearer may desire a tight fit at the rib band, armhole, and neckline locations. The layer of silicone also may improve the durability of main body 102, as any potential fraying of the layers of material may be inhibited. Finally, the layer of silicone provides an aesthetic look and feel, as bra 100 is given a more finished look than if the edges remained bare and also inhibits chafing. The flocking of the silicone layer makes the silicone layer more comfortable for the wearer. Flocking the silicone softens the silicone and makes the silicone less likely to be tacky to the touch.

In some embodiments, bra 100 may be reversible. In other words, the bra may be comfortable to wear and provide the same or nearly the same level of support regardless of which side of bra 100 is worn against the wearer's skin. The seamless nature of many portions of bra 100 allows for reversibility. If the flocked silicone layers used in some embodiments are provided on both sides of bra 100, such embodiments may also be used reversibly.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A bra comprising:

a first layer of material configured to contact a wearer's torso;

a second layer of material overlaying and adhered to the first layer of material, wherein a first portion of the first layer and a first portion of the second layer are molded to form at least one cup configured to encapsulate a wearer's breast;

a rib band adjacent to at least one of the first layer and the second layer;

a framework disposed between the at least one cup and the rib band, wherein the framework is formed from a second portion of the first layer, a second portion of the second layer, and a third layer of material that is disposed between and adhered to the first layer and the second layer, wherein the framework is configured to follow a contour of the at least one cup;

the framework providing a first level of support;

the at least one cup providing a second level of support, wherein the first level of support is greater than the second level of support; and wherein the bra is seamless between the framework and the at least one cup.

2. The bra according to claim 1, wherein the entirety of the first portion of the first layer is adhered to the first portion of the second layer.

3. The bra according to claim 1 further comprising a shoulder strap, wherein the shoulder strap includes a front portion that is contiguous with the at least one cup and a back portion that is attached to the front portion, and wherein the front portion provides a different level of support than the back portion.

4. The bra according to claim 3, wherein the front portion includes a cutout.

5. The bra according to claim 3, wherein the back portion has a racer back configuration.

6. The bra according to claim 2, wherein the shoulder strap includes an adjustment system.

7. A bra comprising:

an inner lining configured to contact a wearer's torso;

an outer layer overlaying the inner lining;

at least one molded cup formed from a first portion of the inner lining and a first portion of the outer layer, the at least one molded cup configured to encapsulate a wearer's breast;

a framework, wherein the framework is formed from a second portion of the inner lining, wherein the second portion of the inner lining is contiguous with the first portion of the inner lining to provide a seamless transition between the at least one molded cup and the framework, a second portion of the outer layer, wherein the second portion of the outer layer is contiguous with the first portion of the outer layer to provide a seamless transition between the at least one molded cup and the framework, and a first material that is disposed between and adhered to the inner lining and the outer layer, wherein the framework is configured to follow a contour of the at least one molded cup; and a shoulder strap having a front portion and a back portion, wherein the front portion is formed from a third portion of the inner lining, a third portion of the outer layer, and a second material that is disposed between and adhered to the inner lining and the outer layer, wherein the first material is a different type of material from the second material.

8. The claim according to claim 7, wherein the back portion is formed from a fourth portion of the inner lining, a fourth portion of the outer layer, and a third material that is disposed between and adhered to the inner lining and the outer layer.

9. The claim according to claim 8, wherein the first material and the third material are the same type of material.

10. The claim according to claim 7, wherein the first portion of the inner lining is adhered to the first portion of the outer layer.

11. The bra according to claim 10, wherein the entirety of the first portion of the inner liner is adhered to the first portion of the outer layer.

12. The bra according to claim 7, wherein the shoulder strap includes a cutout.

13. The bra according to claim 7, wherein the shoulder strap includes an adjustment system.

14. The bra according to claim 13, wherein the adjustment system comprises a hook and a series of slots associated with the shoulder strap, wherein the slots are configured to receive the hook.

15. A bra comprising:

a first layer of material and a second layer of material overlaying the first layer of material, the first layer of material and the second layer of material together forming a first region, a second region, and a third region;

wherein the first region includes at least one molded cup configured to encapsulate a wearer's breast and provides a first level of support;

wherein the second region includes a front portion of a shoulder strap extending from the at least one molded cup and provides a second level of support;

wherein the third region includes a third layer of material sandwiched between the first layer of material and the second layer of material and a framework disposed adjacent the at least one molded cup and wherein the third region provides a third level of support; and wherein the bra is seamless between the first region and the third region.

16. The bra according to claim 15, wherein the third region comprises a back portion of the shoulder strap.

17. The bra according to claim 15, further comprising a fourth region including a back panel, and wherein the first region and the fourth region include the same type of laminate material.

18. The bra according to claim 15, wherein the second and third regions comprise three layers of material adhered together.

19. The bra according to claim 18, wherein the third material is adhered to the first material and the second material in the second region, and the third region comprises the first material, the second material, and a fourth material sandwiched between and adhered to the first material and the second material, and wherein the fourth material has a greater stiffness than the third material.

20. The bra according to claim 19, wherein the first region comprises the first material adhered to the second material.

21. A bra comprising:

a first layer of material configured to contact a wearer's torso;

a second layer of material overlaying and adhered to the first layer of material, wherein a first portion of the first layer and a first portion of the second layer are molded to form a first cup configured to encapsulate a wearer's breast;

at least one armhole formed in the first layer and the second layer and configured to receive a wearer's arm;

a neckline formed in the body layer and the second layer and configured to receive a wearer's neck;

a rib band adjacent to at least one of the first layer and the second layer and configured to encircle a wearer's rib cage;

a framework disposed between the first cup and the rib band, wherein the framework is formed from a second portion of the first layer, a second portion of the second layer, and a third layer of material that is disposed between and adhered to the first layer and the second layer, wherein the framework is configured to follow a contour of the first cup;

the framework providing a first level of support;

the first cup providing a second level of support, wherein the first level of support is greater than the second level of support and wherein the bra is seamless between the framework and the first cup; and wherein a layer of flocked silicone is disposed upon at least one of the armhole, the neckline, and the rib band.

22. The bra according to claim 21 wherein the layer of flocked silicone is disposed upon each of the armhole, the neckline, and the rib band.

23. The bra according to claim 21, wherein the layer of flocked silicone is positioned to be in contact with a wearer's torso.

24. The bra according to claim 21 wherein the entirety of the first portion of the first layer is adhered to the first portion of the second layer.

25. The bra according to claim 24 further comprising a second cup, wherein a leg of the framework separates the first cup and the second cup.

* * * * *